US005315781A

United States Patent [19]

Beisner

[11] Patent Number: 5,315,781

[45] Date of Patent: May 31, 1994

[54] ATTITUDE ORIENTATION DEVICE FOR SCOPE CARRYING FIREARMS

[76] Inventor: David A. Beisner, 3903 Courtland Cir., Alexandria, Va. 22305

[21] Appl. No.: 878,457

[22] Filed: May 5, 1992

[51] Int. Cl.[5] ..... F41G 1/387

[52] U.S. Cl. ..... 42/101; 42/1.01; 33/245

[58] Field of Search ..... 42/101, 100, 103, 1.01; 33/245, 246, 247, 248

[56] References Cited

U.S. PATENT DOCUMENTS

| | | | |
|---|---|---|---|
| 3,556,666 | 1/1971 | Lichtenstein | 33/245 |
| 4,561,204 | 12/1985 | Binion | 33/245 |
| 4,756,111 | 7/1988 | Lapier | 42/101 |
| 5,005,308 | 4/1991 | Parks | 42/101 |

FOREIGN PATENT DOCUMENTS

| | | | |
|---|---|---|---|
| 313105 | 6/1918 | Fed. Rep. of Germany | 33/245 |
| 349062 | 1/1935 | Fed. Rep. of Germany | 42/1.01 |
| 3401855 | 7/1985 | Fed. Rep. of Germany | 33/246 |
| 3834924 | 4/1990 | Fed. Rep. of Germany | 42/100 |

*Primary Examiner*—Stephen M. Johnson

[57] ABSTRACT

A firearm having an attitude indicator, a stock, a barrel having a shooting axis, and a scope positioned above the barrel and having a sighting axis, the common plane in which the shooting axis and the sighting axis lie constituting the firearm plane, and wherein, for proper sighting, the firearm plane must be substantially vertically oriented, the attitude indicator having a level with a horizontal functional plane, a support for the indicator, and an attachment mechanism for mounting the support on the firearm with the functional plane of the indicator oriented substantially normal to the firearm plane and with the indicator lying within the binocular field incident to the sighting axis of the scope.

11 Claims, 1 Drawing Sheet

"LBF"
"FP"
"HFP"
"BF"
"RBF"

ATTITUDE ORIENTATION DEVICE FOR SCOPE CARRYING FIREARMS

FIELD OF THE INVENTION

This invention concerns a device for use with scope carrying firearms, particularly rifles which are shoulder held, the device providing a means whereby the shooter, without interruption of his sighting through the scope, and without having to move or refocus his sighting eye with respect to the cross-hairs thereof, can place the firearm in the most accurate shooting position.

BACKGROUND OF THE INVENTION

Typically, firearms with scopes must be held in a certain posture if the scope is to accurately zero in on the target. Where the scope is mounted over the top of the barrel it cannot give an accurate sighting unless the sighting axis thereof and the firearm shooting axis lie essentially in a common vertical plane, i.e., unless the rifle and scope are not canted. This requirement for achieving ultimate marksmanship is elucidated, for example, in the article entitled "SUPER SCOPES" on pages 46–49 of *Precision SHOOTING*, vol. 37-No. 2, June 1991.

DISCUSSION OF PRIOR ART

With further reference to the SUPER SCOPES article, a vertical post, level indicating device is described therein which indicates to the shooter the degree of canting, if any, of the rifle. This device is built into the scope and is visible to the shooter only with his sighting eye. With this device, the sighting eye must refocus on the level indicator, even though such refocusing may require only a very short period of time. Also, such vertical post type indicators are purely mechanical and can develope frictional resistance to proper motion of the post during sightings above and below the horizontal, and also must be manufactured to fine tolerances which leads to excessively high pricing of the scope as is evident from the article.

OBJECTS OF THE INVENTION

Objects, therefore, of the present invention are: to provide a means or device which can be affixed to a firearm and which functions to indicate to a shooter the degree of canting, if any, of the firearm, without the shooter having to adjust or refocus his sighting eye; to provide such device which is not operative in a mechanical sense and which can function perfectly regardless of the posture of the barrel axis with respect to the horizontal; to provide such device which is adaptable in use to virtually any type or configuration of scoped firearm; and to provide such device which is uncomplicated, easy to manufacture, and inexpensive.

SUMMARY OF THE INVENTION

These and other objects hereinafter appearing have been attained in accordance with the present invention through the discovery which is broadly defined in its utility embodiment as a firearm having attitude indicator means, said firearm having barrel means having a shooting axis, and scope means positioned above said barrel means and having a sighting axis, the common plane in which said shooting axis and said sighting axis lie constituting the firearm plane, and wherein, for proper sighting, said firearm plane must be substantially vertically oriented, said attitude indicating means comprising level means having a horizontal functional plane, support means for said level means, and attachment means for mounting said support means on said firearm with the functional plane of said level means oriented substantially normal to said firearm plane and with said level means lying within the binocular field incident to said sighting axis of said scope means.

In accordance with the structure recited above, the shooter can readily discern through the use of his binocular facility in viewing the level means with his binocular eye, the rifle attitude, i.e., the angle which the plane of the scoped rifle makes with the horizontal, such that any necessary rotational adjustment of the rifle by the shooter in order to bring the rifle plane into its vertical orientation can be made to provide the most accurate shooting posture.

PREFERRED EMBODIMENTS

In certain preferred embodiments of the invention as recited above:

(1) said level means comprises elongated bubble or spirit level means;

(2) said support means and said level means are provided with cooperating, friction-grip surface means which allow said level means to be frictionally, slidably moved on said support means substantially within its functional plane for adjusting its position of view within said binocular field;

(3) said support means comprises a pair of split collar segments dimensioned to fit snugly around said scope means, and wherein said attachment means comprises a screw and thread combination for clamping said segments together; and (4) said level means is supported in close proximity to said scope means and substantially underneath the same, and wherein said level means comprises a bubble-in-tube type having a longitudinal axis oriented substantially normal to said firearm plane.

BRIEF DESCRIPTION OF THE DRAWINGS

The invention will be further understood from the following drawing and description thereof wherein the scale and dimensional proportions are not intended to be actual, but only approximate and for explanatory purposes only.

DETAILED DESCRIPTION OF THE INVENTION

Figures 1, 2, 3, 4, 5, 6, 7:
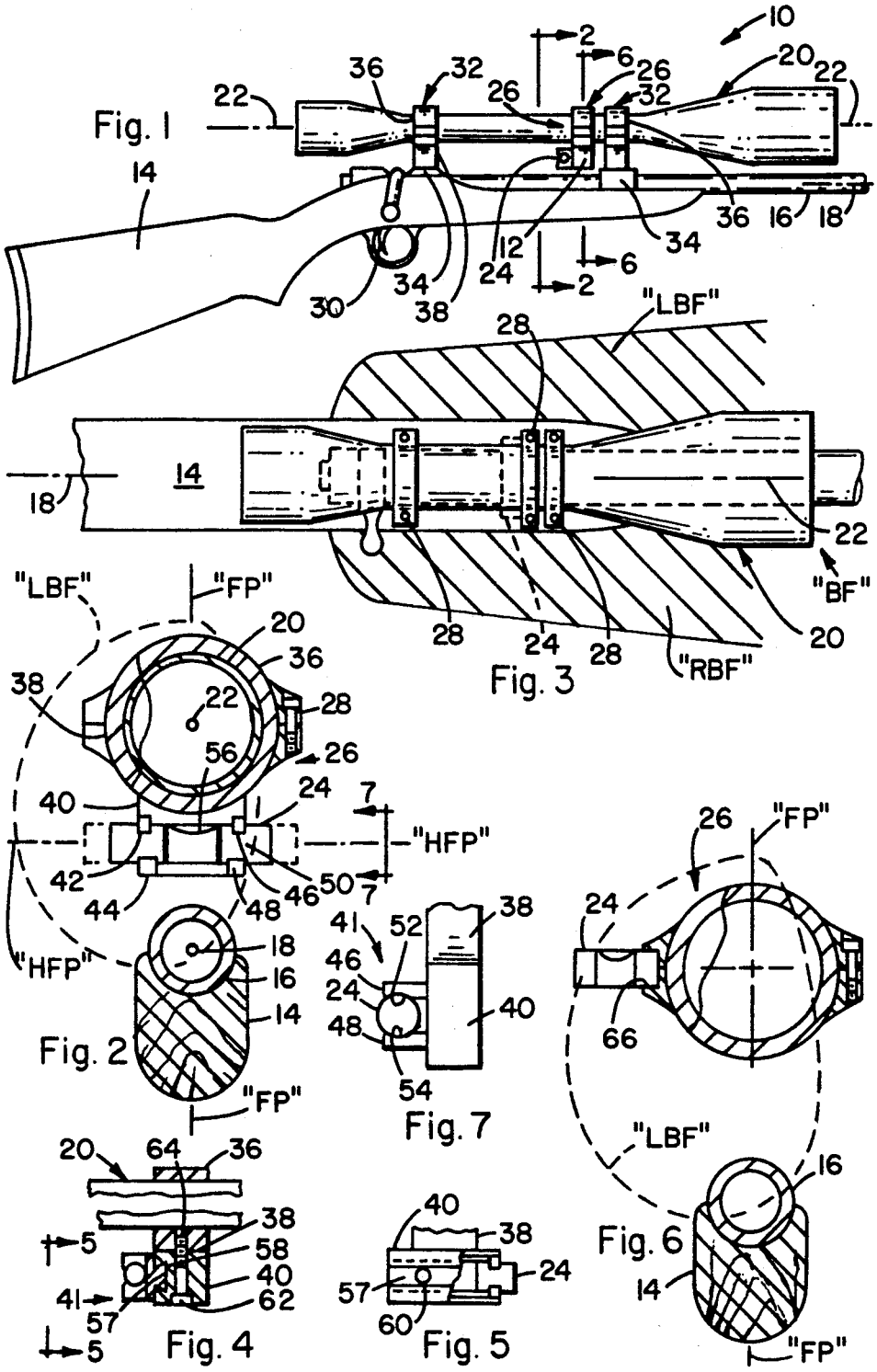
FIG. 1 is a side elevation of a scoped rifle with the present attitude indicator device mounted thereon in a preferred location.
FIG. 2 is an enlarged, cross-sectional view mainly taken along line 2—2 of FIG. 1 in the direction of the arrows and approximately indicating the left binocular field by dotted line.
FIG. 3 is a top elevational view of the scoped rifle of FIG. 1 approximately indicating both the right and left lateral binocular field limits.
FIG. 4 is a cross-sectional view of a variation of the support means for the level means showing both pivotal and longitudinal adjustment means for the level means.
FIG. 5 is a view taken in the direction of arrow 5 in FIG. 4 with portions broken away to show the keyway.
FIG. 6 is a cross-sectional view taken mainly along line 6—6 of FIG. 1 and showing a variation of the support means structure and indicator means placement.
FIG. 7 is an enlarged view of the clamping means for the level means taken in the direction of arrow 7 in FIG. 2.

Referring to the drawing and to the claim hereof, the present invention in its utility embodiment, i.e., with the attitude indicator means mounted on the firearm, is broadly defined as a firearm 10 having attitude indicator means 12, said firearm comprising stock means 14, barrel means 16 mounted thereon and having a shooting axis 18, and scope means 20 positioned above said barrel means and having a sighting axis 22, the common plane in which said shooting axis and said sighting axis lie constituting the firearm plane, "FP", and wherein, for proper sighting, said firearm plane must be substantially vertically oriented, said attitude indicator means comprising level means 24 having a horizontal functional plane "HFP", support means 26 for said level means, and attachment means 28 for mounting said support means on said firearm with the horizontal functional plane of said level means oriented substantially normal to said firearm plane and with said level means lying within the binocular field "BF" incident to said sighting axis of said scope means.

The firearm to which the present invention is applicable can have essentially any shape or configuration of barrel means, which term as used herein includes any stock or the like 14 associated with the barrel per se, and can have any type of loading chamber construction including bolt action, gas ejection, or the like and can have any type of firing mechanism such as a trigger 30 or any type of remote and/or electronic actuation means.

The scope means may be of any type and power and is affixed to the firearm in conventional manner by clamping brackets or collars such as 32 secured to mounting plinths 34 on the barrel. Such collars brackets conventionally take the form of upper and lower segments 36 and 38 respectively, bolted together, and are shown in further detail in FIG. 2 wherein such general clamping structure is also employed as supporting structure for the present attitude indicator means and is numbered the same.

The preferred support means 26 for the level means comprises the collar segments 36 and 38, segment 38 having depending leg means 40 provided with clamping means 41 comprising upper finger pair 42 and lower finger pair 44, at least one of which pairs is resilent and slightly flexible to allow the level means 24 to be pushed and snapped therebetween. The distal ends 46 and 48 of said fingers are formed to partially engage the outer surface 50 of the level means in a clamping manner. The inner surfaces 52, 54 of these fingers as shown in FIG. 7 provide friction-grip surfaces for tightly holding the level means 24 but allowing the same to be slid, under substantial force, to the left or right along its longitudinal axis as shown by the dotted outlines of the level means in FIG. 2, in order to adjust its position within the binocular field "BF" as desired by a particular shooter for attaining maximum visibility of the spirit bubble 56. This support structure can have any of a wide variety of shapes and the position of the level means may be non-adjustable, however, the adjustable structure shown or its reasonable equivalents are most preferred.

Referring to the embodiment of FIGS. 4 and 5, the depending leg means 40 is separate from the lower bracket segment 38 and carries the clamping means 41 within a keyway 57, the clamping means having the form of mating key bar 58 on which the finger pairs 42 and 44 are affixed or integrally formed. As shown of FIG. 5, a set screw 60 or the like may be threaded through the back of leg means 40 to engage bar 58 to press it against the front of keyway 57 and fix its adjusted position along said keyway. Leg means 40 in this embodiment, may also be pivotally adjustable within the horizontal plane of the level means by means of machine screw means 62, e.g., an Allen screw or bolt, threaded into bore 64 in segment 38. A simple loosening of screw means 62 will allow pivoting of leg means 40 and the level means 24 to a position desirable for improving its viewability.

In the embodiments depicted in the drawing, the various support means for the level means are adapted for mounting on the barrel of the scope, however, such collar segments or similar or alternative structures may also be adapted to affix the level means to the stock. The location of the indicator means along the length of the scope may of course be varied depending on the particular seeing ability or other characteristics of the shooter.

Referring to FIG. 6, a modification of the level means support and its positioning on the scope is shown. The level means in this embodiment is frictionally forced into and retained in a recess 66 in the support means 26. This recess, or any equivalent retaining structure can be provided anywhere on the support means, and any number of such retaining structures and level means may be employed simultaneously. The important aspect is that the bubble of the level means lie within the binocular field, e.g., referring to FIG. 6, within the left eye visibility field roughly depicted by the dotted line "LBF", i.e., left binocular field. In this regard, it goes without saying that for a left eye shooter, the right binocular field "RBF" will dictate the position of the level means, however, some overlap of these two viewing fields will naturally exist.

It is noted that in using the present invention, both the brain and the binocular eye, i.e., the eye which views the level means, become rapidly adapted to independent viewing of the level means even though the sighting eye may not leave the cross-hairs of the scope.

This invention has been described in detail with particular reference to preferred embodiments thereof, but it will be understood that variations and modifications can be effected by those skilled in the art without departing from the spirit and scope of the invention.

I claim:

1. A firearm having attitude indicator means, said firearm comprising barrel means having a shooting axis, and scope means positioned above said barrel means and having a sighting axis, said scope means having an eyepiece, said shooting axis and said sighting axis lying in a common plane constituting a firearm plane of said firearm, the arrangement of said shooting axis and sighting axis within said firearm plane providing a binocular field extending below and laterally to each side of said scope means, said binocular field being viewable only with the eye not being used for sighting through the eyepiece of said scope means, and wherein, for proper sighting, said firearm plane must be substantially vertically oriented, said attitude indicator means comprising bubble level means adapted to indicate the attitude of said firearm plane with respect to the horizontal, support means for said level means, and attachment means for mounting said support means on said scope means with said level means lying exteriorly to said scope means and forwardly of said eyepiece thereof and within said binocular field.

2. The firearm of claim 1 wherein said support means and said level means are provided with cooperating, friction-grip surface means which allow said level means to be frictionally, slidably moved on said support means for adjusting the position of said level means within said binocular field.

3. The firearm of claim 2 wherein said level means comprises an elongated, tubular bubble level having a longitudinal axis lying in a level plane oriented substantially normal to said firearm plane, and wherein said support means is provided with pivot means for allowing angular adjustment of said bubble level within said level plane for further adjusting the position of said bubble level within said binocular field.

4. The firearm of claim 1 wherein said support means comprises a pair of split collar segments dimensioned to fit snugly around said scope means, and wherein said attachment means comprises a screw and thread combination on said segments for clamping said segments together.

5. The firearm of claim 4 wherein said level means is supported in close proximity to and at least partially underneath said scope means, and wherein said level means comprises a straight, tubular bubble level having a longitudinal axis oriented substantially normal to said firearm plane.

6. The firearm of claim 1 wherein said level means is supported in close proximity to and at least partially underneath said scope means.

7. The firearm of claim 1 wherein said level means comprises an elongated, tubular bubble level having a longitudinal axis lying in a level plane oriented substantially normal to said firearm plane, and wherein said support means is provided with pivot means for allowing angular adjustment of said bubble level within said level plane for adjusting the position of said bubble within said binocular field.

8. An attitude indicator device for attachment to scope means of a firearm having a barrel with a longitudinal axis, said device comprising bubble level means adapted to indicate the rotational attitude of said firearm with respect to said longitudinal axis, support means for said level means, and attachment means for mounting said support means on said scope means with said level means lying exterior to said scope means, wherein said support means comprises a pair of split collar segments dimensioned to fit snugly around said scope means, and wherein said attachment means comprises a screw and thread combination on said segments for clamping said segments together.

9. The device of claim 8 wherein said support means and said level means are provided with cooperating, frictional-grip surface means which allow said level means to be frictionally, slidably moved on said support means for adjusting the position of said level means with respect to said scope means within a binocular field comprising a viewing area extending below and laterally to each side of said scope means.

10. The device of claim 9 wherein said level means comprises an elongated, straight tubular bubble level having a longitudinal axis lying in a level plane oriented substantially normal to said firearm plane, and wherein said support means is provided with pivot means for allowing angular movement of said level within said level plane for adjusting the position of said level with respect to said scope means within said binocular field.

11. The device of claim 8 wherein said level means comprises an elongated, straight, tubular bubble level having a longitudinal axis lying in a level plane oriented substantially normal to said firearm plane, and wherein said support means is provided with pivot means for allowing angular movement of said level within said level plane for adjusting the position of said level with respect to said scope means within a binocular field comprising a viewing area extending below and laterally to each side of said scope means.

* * * * *